US005829611A

United States Patent [19]

Beck

[11] Patent Number: 5,829,611

[45] Date of Patent: Nov. 3, 1998

[54] TAMPER-EVIDENT OVERCAP

[75] Inventor: James M. Beck, Buffalo Grove, Ill.

[73] Assignee: Creative Packaging Corp., Buffalo Grove, Ill.

[21] Appl. No.: 726,511

[22] Filed: Oct. 7, 1996

[51] Int. Cl.[6] ..... B65D 41/47

[52] U.S. Cl. ..... 215/252; 215/256; 215/278; 220/257

[58] Field of Search ..... 215/252, 256, 215/278; 220/257

[56] References Cited

U.S. PATENT DOCUMENTS

| | | | |
|---|---|---|---|
| 4,624,378 | 11/1986 | Sawicki | 215/230 |
| 4,709,823 | 12/1987 | Beck et al. . | |
| 4,746,035 | 5/1988 | Anderson et al. | 215/252 X |
| 4,821,897 | 4/1989 | Weiler . | |
| 4,919,285 | 4/1990 | Roof et al. | 215/230 |
| 5,085,333 | 2/1992 | Dutt et al. . | |
| 5,284,263 | 2/1994 | Papciak | 215/230 |
| 5,335,802 | 8/1994 | Brach et al. . | |
| 5,456,374 | 10/1995 | Beck . | |
| 5,507,416 | 4/1996 | Rapchak et al. . | |

*Primary Examiner*—Jes F. Pascua
*Attorney, Agent, or Firm*—Silverman, Cass & Singer, Ltd.

[57] ABSTRACT

A tamper-evident cap and overcap including a cap with an upstanding cap portion and a lower base, the base defining a circumferential channel. An overcap is positioned to enclose the upstanding cap portion, with the overcap carrying a circumferential projection or skirt permanently retained in the circumferential channel, typically by force-fit. A frangible line of weakness permits separation of the overcap and the circumferential projection. At least the circumferential projection, and typically also the overcap, are of a color that contrasts with the color of the cap, so that, upon removal of the cap, the remaining edge of the circumferential projection gives an indication that the overcap has been removed.

4 Claims, 4 Drawing Sheets

FIG. 3
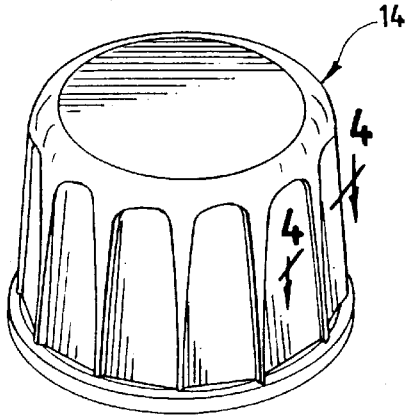
FIG. 4
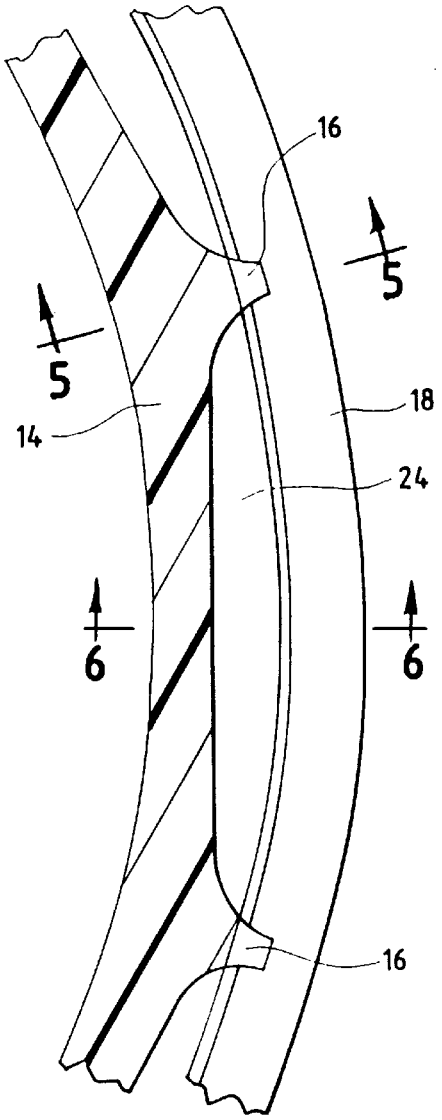
FIG. 5
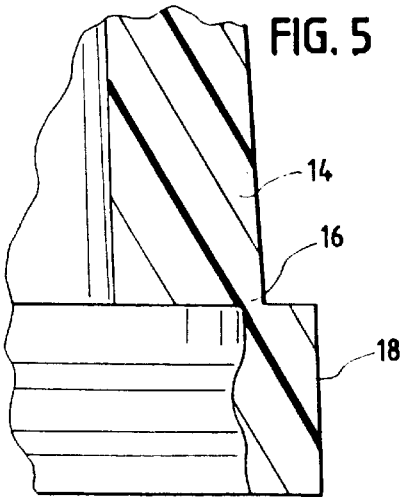
FIG. 6
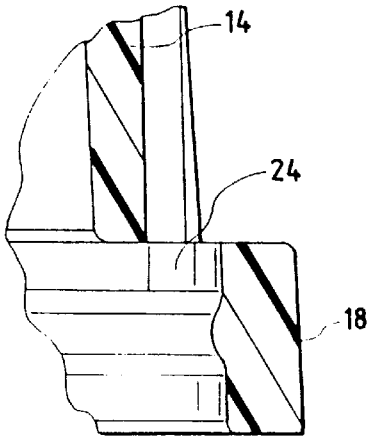
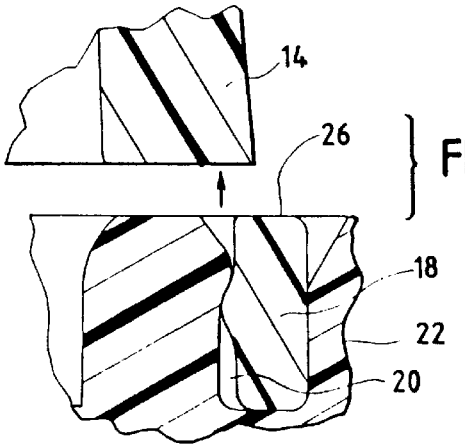
FIG. 7

TAMPER-EVIDENT OVERCAP

BACKGROUND OF THE INVENTION

1. Field of the Invention

This invention relates generally to closures for re-sealable containers, and more particularly, to a tamper-evident overcap for such a closure.

2. Description of the Prior Art

Caps for containers having removable overcaps are well-known and used for many different types of containers. The overcap typically is removable prior to when use of the container is initiated. The cap typically is openable and closeable on a temporary basis. The overcap usually can be re-used or discarded as desired by the user of the container.

It is desirable for some indication to be present that the overcap has been removed. Typically, a prior art overcap may be attached to a circumferential skirt such as a circular flange which is positioned over the cap. The overcap and circumferential skirt are connected together by frangible webs, so that by twisting of the overcap it is broken loose from the circumferential skirt, and thus cannot be reattached. In such structure, however, evidence of removal of the overcap may not readily be apparent to the user.

The present invention provides a significantly visible tamper-evident indicator of removal of the overcap, so that the user will know that an overcap once was present and that the container has been opened or tampered with.

SUMMARY OF THE INVENTION

The invention provides a tamper-evident overcap in which the tamper evident characteristic is enhanced in a manner that is of virtually no increased cost, and yet which provides a significant, highly visible indication to the user, above and beyond the mere absence of the overcap.

The invention includes a cap for a container, the cap defining an upstanding cap portion and a lower base. The base defines a circumferential channel, which may be completely circular, or may define interrupted arcs or some other portion of a circle.

An overcap is positioned to enclose the upstanding cap portion. The overcap carries a circumferential skirt or projection which is of a shape similar to the circumferential channel, and is permanently retained in the circumferential channel, typically by force-fitting, or by gluing, RF sealing, or any other desired manner.

A frangible line of weakness, such as spaced spot seals or other connecting members, permits separation of the overcap from the circumferential skirt. The overcap and the circumferential skirt are of an integral structure, being typically a single, molded item, and also, by this invention, are of a color that contrasts with the color of the cap. Thus, the overcap and cap are formed from materials which are of different visual perception that enables an observer to differentiate one from the other. In other words, if the cap is a bright red color, the overcap may be a darker, contrasting color such as blue, black, or green. If the cap is of a dark color, then the overcap may be of a brighter, contrasting color such as red, white or yellow. Also, the overcap may be transparent, with the cap being of a darker color, so that the remaining edge of the circumferential skirt, permanently secured in the circumferential channel, is clearly noticeable after removal of the overcap. Materials of differing perception other than color also may be used to achieve the objects of this invention. For example, one part may be formed of a material of texture different than the other.

The cap and overcap of this invention may be used with any desired container, for example bottles for water, syrup, shampoo, soap, comestibles, or the like or, if desired, for larger containers of industrial materials having volumes of one gallon and greater.

By this invention, an added, tamper-evident characteristic of the cap and overcap becomes highly visible upon removal of the overcap, and this can be accomplished merely by proper selection of the colors of the cap and overcap, which can be accomplished at essentially no cost increase over corresponding constructions in the prior art.

BRIEF DESCRIPTION OF THE DRAWINGS

FIG. 3 is a perspective view of the overcap prior to installation on its associated cap;

FIG. 4 is an enlarged, sectional view taken along the line 4—4 of FIG. 3, in the direction indicated generally;

FIG. 5 is a further enlarged, sectional view taken along the line 5—5 of FIG. 4, in the direction indicated generally;

FIG. 6 is a further enlarged, sectional view taken along the line 6—6 of FIG. 4, in the direction indicated generally;

FIG. 7 is a transverse sectional view similar to that of FIG. 5, showing how the overcap can be separated from its associated skirt by breakage of spot seals;

DESCRIPTION OF THE PREFERRED EMBODIMENTS

Figure 1:
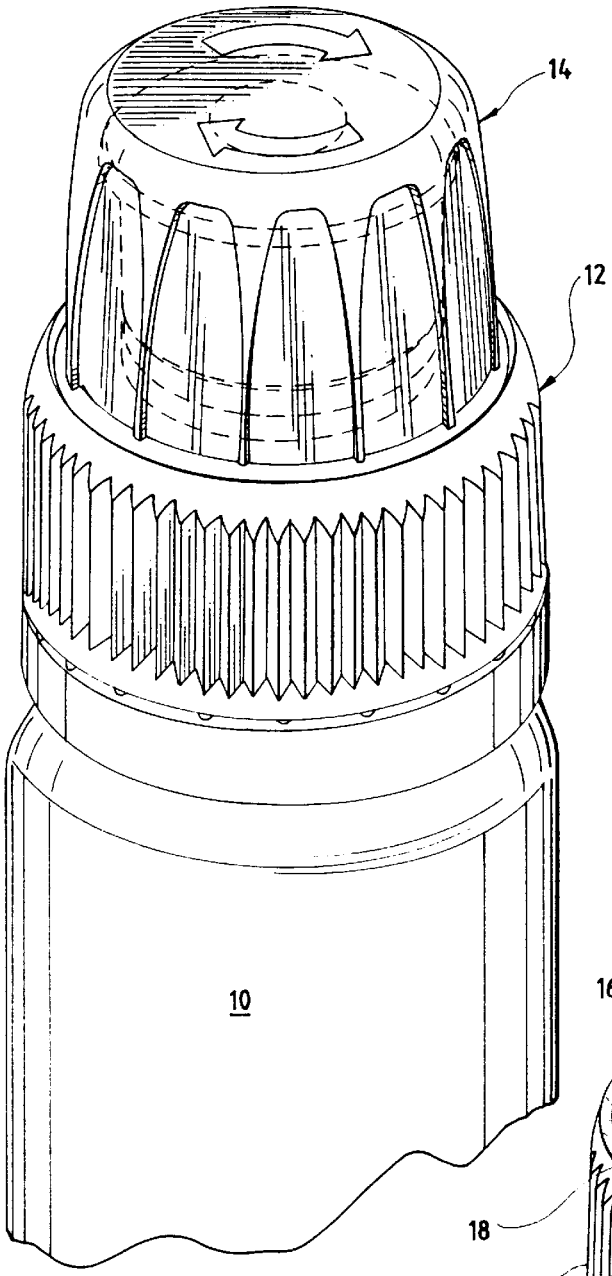
FIG. 1 is a perspective view of a cap and overcap in accordance with this invention, with the overcap shown in its initial, closed position.
Figure 2:
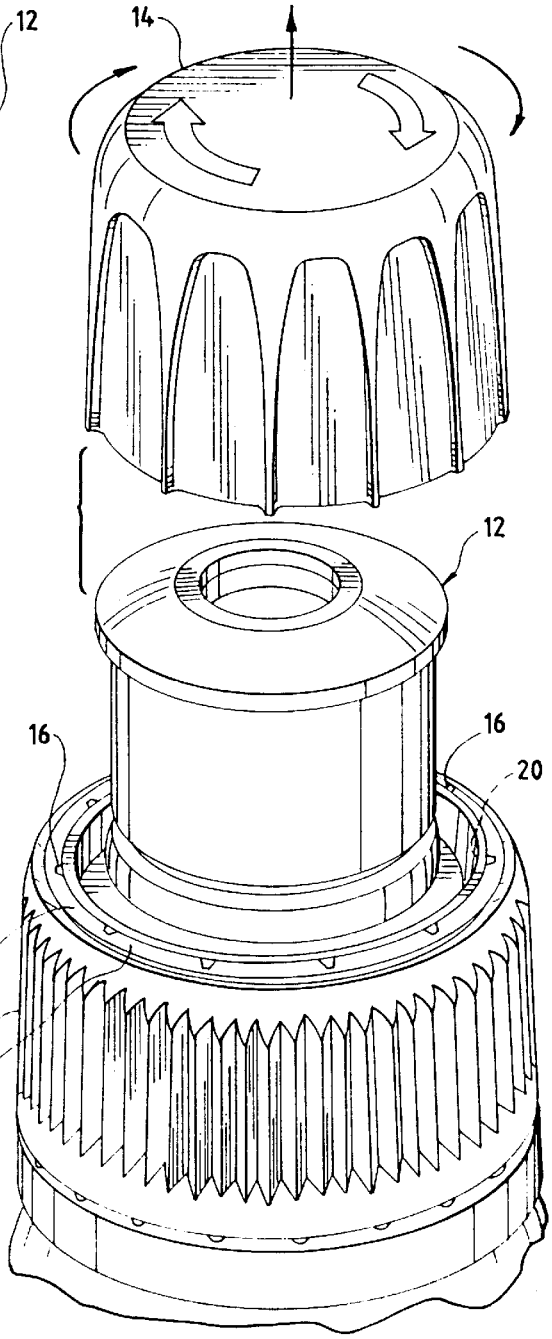
FIG. 2 shows the cap and overcap of FIG. 1 with the overcap being removed by twisting relative to the cap, leaving behind the circumferential skirt or projection.
Figure 13:
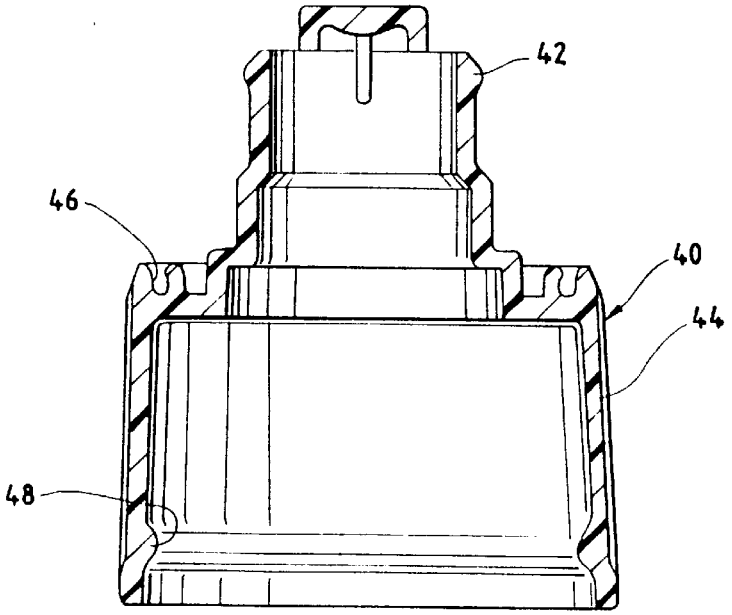
FIG. 13 is a sectional view taken along the line 13—13 of FIG. 12, in the direction indicated generally.

Referring to FIG. 1, a container 10 is shown having a cap 12 and an overcap 14, which may be similar to the constructions of the prior art except as otherwise described herein. Cap 12 may be attached to container 10 in a conventional manner, such as by threaded engagement (FIG. 11) or by snap-fit over the container opening (FIG. 13).

Referring to FIGS. 2–7, when it is desired to gain access to the contents of the container, overcap 14 is simply twisted and lifted off, which could be indicated by the arrows or instructions on the container label, breaking frangible spot seals or connections 16, which connect overcap 14 with a circumferential skirt or projection 18 that is permanently retained by a force-fit into circumferential channel 20 which is defined in a base 22 of cap 12. Thus, as shown in both FIGS. 2 and 3, overcap 14 has now been separated from its circumferential skirt 18 which resides in circumferential channel 20 as particularly shown in FIG. 7.

FIGS. 4–6 show details of the overcap structure, particularly spot seals or frangible connections 16, which intermittently connect overcap 14 with circumferential skirt 18. Overcap 14 and circumferential skirt 18 may be spaced from each other as illustrated by spaces 24 at other portions about their periphery.

In accordance with this invention, overcap 14 and circumferential skirt 18, which may be initially a single, integrally molded item, may be colored an arbitrary color white, while cap 12, and particularly base 22 thereof, may be colored a contrasting arbitrary color dark blue. Thus, one can visually see a white ring 26 after removal of overcap 14, which plainly signifies to the viewer the fact than an overcap has been removed. The important feature is that the overcap and cap are formed from materials which are of a differing visual perception (such as color) to enable an observer to differentiate one from the other.

Figure 8:
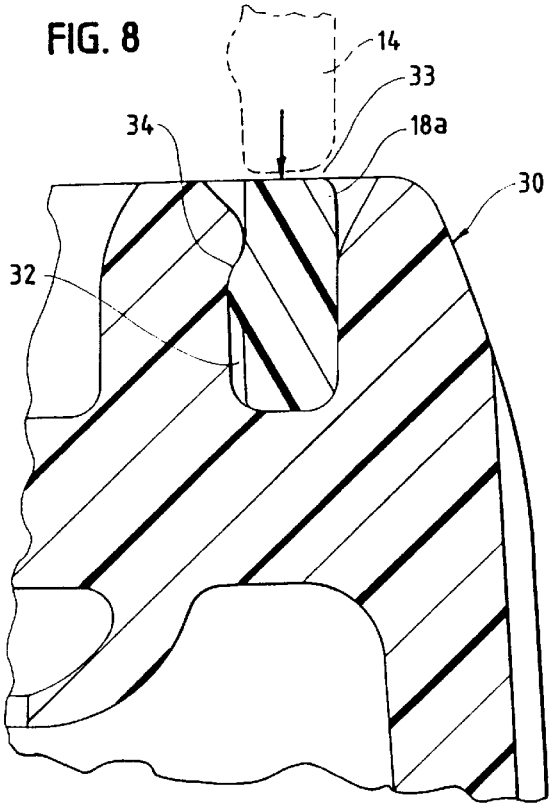
FIG. 8 is an enlarged, fragmentary, transverse sectional view showing how the circumferential skirt of the overcap can be force-fit in an effectively permanent manner into the circumferential channel in the cap.

Referring to FIG. 8, the cap 30 for a container is shown, having a circumferential channel 32 which contains a circumferential skirt 18*a* of an overcap 14. Both channel 32 and projection 18*a* may be shaped with a detent system 34 so that when projection 18*a* is forcefully inserted into channel 32, it cannot be removed, but instead cap 14 is separated from projection 18*a* by breakage of spot seals or the like along a line of weakness 33.

Figure 9:
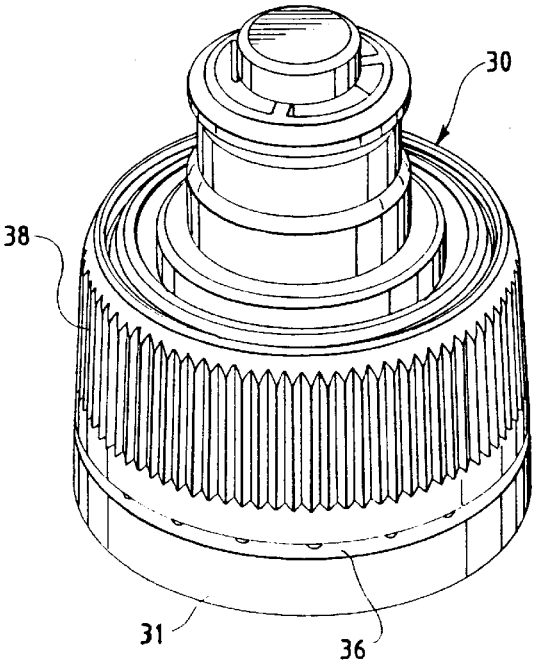
FIG. 9 is a perspective view of a portion of the cap shown in FIG. 2.
Figure 10:
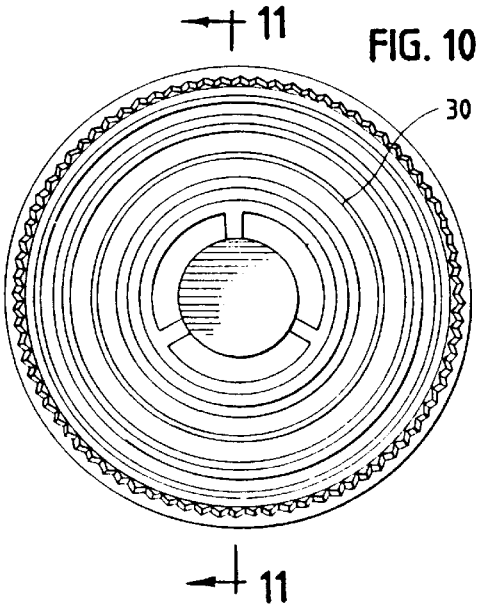
FIG. 10 is a plan view of the cap of FIG. 9.
Figure 11:
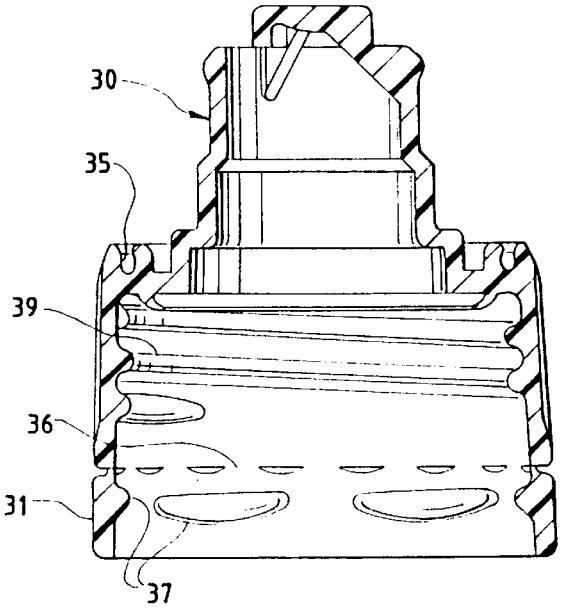
FIG. 11 is a longitudinal sectional view taken along the line 11—11 of FIG. 10, in the direction indicated generally.

Referring to FIGS. 9–11, a portion 30 of a cap is shown, in which the cap is affixed to a container top with a tamper evident band 31 to be separated from the portion 30 along a separation line 36 when the cap is twisted by the user by asserting a force upon the knurled surface 38. The portion 30 is secured to the container top by screw threads 39. The tamper band is retained on the container top by inwardly projecting member 37 to engage a flange (not shown) on a container top. The cap portion 30 is formed with a circumferential channel 35 to receive the skirt 18 of overcap 14.

Figure 12:
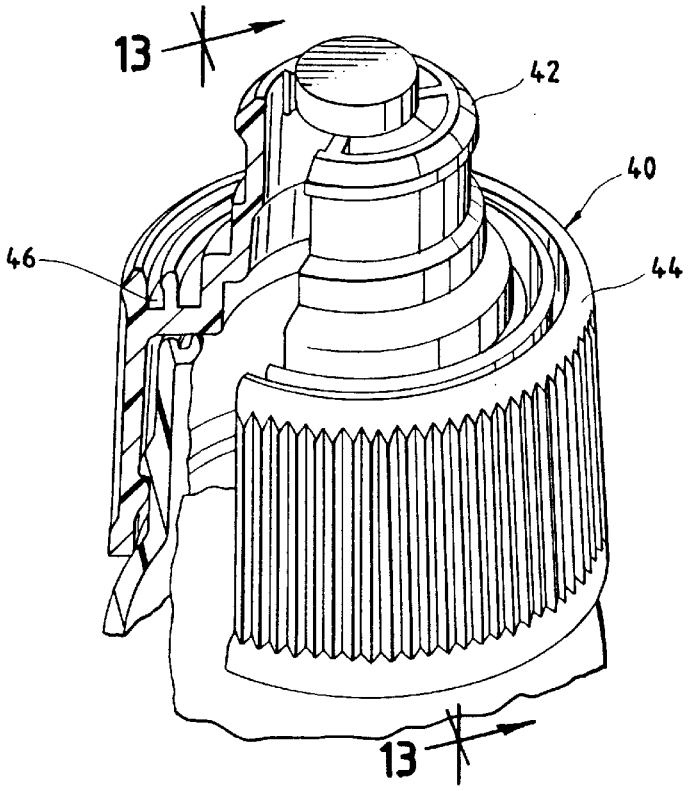
FIG. 12 is a perspective view of another embodiment of the cap used in this invention, shown to be installed on a container and having a circumferential channel for receiving an overcap.

Referring to FIGS. 12 and 13, another cap 40 is shown, which may be enclosed by overcap 14. Cap 40 comprises an upstanding cap portion 42 and a lower base portion 44 which is snap-fit over a container (not shown) by engagement of indentation 48 with the container top. An overcap 14 may be engaged on cap 40 by positioning its skirt 18 within channel 46.

The above has been offered by illustrative purposes only, and is not intended to limit the scope of the invention of this application, which is as defined in the claims below.

What is claimed and desired to be secured by Letters Patent of the United States is:

1. A tamper-evident cap and overcap comprising, a cap for a container, said cap defining an upstanding cap portion and a lower base, said base defining a generally U-shaped circular channel having side walls and a bottom lying entirely within the base, and an overcap positioned to enclose said upstanding cap portion, said overcap carrying a circumferential skirt press fitted into said channel to prevent any relative movement between said cap and overcap, and a frangible line of weakness between said overcap and said skirt permitting separation of said overcap and said skirt, said skirt being of a color different from said cap whereby upon separation of said overcap, said skirt remains gripped in said channel serving as a colored ring indicator of overcap removal.

2. The cap and overcap of claim 1 in which said skirt and channel are provided with a detent system to aid in press fitting said skirt in said channel.

3. The cap and overcap of claim 1 in which said circular channel is spaced from said upstanding cap portion throughout its extent.

4. The cap and overcap of claim 1 in which said skirt remains gripped in said channel so that the separated portion of said skirt lies flush with the open end of said U-shaped channel.

* * * * *

UNITED STATES PATENT AND TRADEMARK OFFICE

CERTIFICATE OF CORRECTION

PATENT NO. : 5,829,611

DATED : November 3, 1998

INVENTOR(S) : James M. Beck

It is certified that error appears in the above-indentified patent and that said Letters Patent is hereby corrected as shown below:

Add the following claim 5:

5. The cap and overcap of claim 1 in which said overcap and skirt are integrally molded.

Title page "4 Claims" should read --5 Claims--.

Signed and Sealed this

Second Day of March, 1999

*Attest:*

*Attesting Officer*

Q. TODD DICKINSON

*Acting Commissioner of Patents and Trademarks*